US006031169A

United States Patent [19]

Coppola

[11] Patent Number: 6,031,169

[45] Date of Patent: Feb. 29, 2000

[54] RIM BLOCK FOR DRUM

[76] Inventor: Michael R. Coppola, 165 Chestnut St., Boonton, N.J. 07005

[21] Appl. No.: 09/239,107

[22] Filed: Jan. 27, 1999

[51] Int. Cl.[7] ..... G10D 13/02

[52] U.S. Cl. ..... 84/411 R; 84/412

[58] Field of Search ..... 84/411 R, 412, 84/413, 453; 248/227.4, 228.3, 231.41

[56] References Cited

U.S. PATENT DOCUMENTS

| | | | |
|---|---|---|---|
| 887,016 | 5/1908 | Poland | 84/413 |
| 3,362,275 | 1/1968 | Koishikawa | 84/411 |
| 4,549,462 | 10/1985 | Hartry et al. | 84/413 |
| 5,410,938 | 5/1995 | Kurosaki et al. | 84/411 R |
| 5,554,812 | 9/1996 | Donohoe | 84/413 |
| 5,561,255 | 10/1996 | Sassmannshausen et al. | 84/413 |

*Primary Examiner*—Robert E. Nappi
*Assistant Examiner*—Kim Lockett
*Attorney, Agent, or Firm*—Friedman Siegelbaum, LLP

[57] ABSTRACT

The present invention is a drum rim protection device designed to protect the rim of bass drums from damage when being struck by a musician. The invention comprises of two members having an outer surface, openings in their inner surfaces, one opening being holes that receives threaded rod which joins the members, the other hole being an arcuate groove sized to receive and receiving a drum rim therein. The members are joined by a pair of threaded rods which are received in a turnbuckle. The groove in each member deepens from the inner surface towards the outer surface, terminating in a cut surface to which is glued a layer of cushioning material, preferably foam rubber. The device is attached to a drum by separating the two members a distance sufficiently greater than the thickness of the drum, engaging the drum rim within the groove of the first member, engaging a second rim within the groove of the second member, and rotating the turnbuckle so that the members are pulled together and the drum is securely retained there between. The cushioning material prevents the drum rim from being scratched by the device. The members are made from a hard wood such as oak, mahogany, cherry or walnut, or of a plastic, rubber or metal. The rim protection device can also be used as a musical instrument, and the members can be made of different materials for its use as an instrument.

40 Claims, 2 Drawing Sheets

RIM BLOCK FOR DRUM

FIELD OF THE INVENTION

The present relates to the field of musical instruments. In particular, the present invention is a device that attaches to and protects the rim of a drum from damage when the rim is struck by a musician while playing the drum. The device also acts as a musical instrument because when it is struck by the musician, whether it is held separately or attached to the drum, it produces a musical tone, and that tone is different from that of the drum.

BACKGROUND OF THE INVENTION

A drum comprises numerous components, but for purposes of this Background of the Invention section only, the elements of concern are the drum's shell, the drum skin or surface, and the drum rim. Essentially, the drum skin is stretched over one or both ends of the shell, and the skin is held in place by the rim. A drum such as a bass drum has two skins, one skin over each surface of the shell, and when the skin is struck with a drum stick or mallet, sound is reverberated between the drum skins, creating the sound characteristic of the drum. A smaller drum, such as a snare drum, also contains two skins over the shell, and is usually struck with a drum stick that is significantly smaller than the drum stick or mallet used to strike a bass drum.

When a drum rim is struck it produces a sound that is different from that of the drum skin, and striking the drum rim is often written as part of a musical arrangement. The sound of the drum rim differs depending upon the materials of which the rim is manufactured. A problem caused by repeated striking of the drum rim by the drummer is damage to the drum rim itself. This is especially among bass drums used in marching bands, where the drum is repeatedly struck by the drummer's heavy drum stick or mallet. Damage to the drum rim can have several effects, such as problems associated with tuning the drum and keeping it in tune, whether or not the drum skin remains stretched tightly and uniformly over the shell of the drum, and the need to replace the drum rim itself, which can be a costly repair. A damaged drum rim may also contribute to damaging the drum skin and require the drum skin to be replaced. If the damage to the rim or rims is severe enough, it may necessitate replacement of the drum altogether. This resulting loss of use of the drum, related "down time" and repair costs can adversely affect a musician or band.

In U.S. Pat. No. 4,970,933 Hsieh describes a reinforced musical drum rim which has a concavity cut out of the drum rim's underside, and which contains a plurality of hexagonally-shaped reinforcement structures in a honeycomb-like arrangement. This drum rim is designed to protect the drum rim from becoming deformed during tuning of the drum, when a plurality of clamping screws are tightened and stretch the drum skin over the open end of the drum body. The drum rim is not readily removable from the drum, nor can it be quickly interchanged without affecting the position of the drum skin.

Fuji et al. describe a drum in which the drum rim is replaced with a reinforced ring which extends above the surface of the drum skin in U.S. Pat. No. 5,587,544. They note that striking the drum rim with a drum stick produces metallic sounds, and by replacing the standard metal drum rim with a reinforced wooden rim, different musical tones, such as those like a tom-tom, can be produced instead of the metallic tones. The ring is held in place by a plurality of head supporting and stretching assemblies mounted on the outer surface of the drum shell, suggesting that it would be difficult to remove this ring readily from the drum without removing the drum skin, and consequently having to retune the drum.

Thus there is a need for an easy to use accessory for a drum which can be readily attached to the shell of the drum and prevent damage to the drum rim or rims, and which can also be used to generate one or more musical tones. The present invention is rim protection device or rim block which is attached to the shell of a bass drum, and protects the rim from damage when struck by a drummer. Further, the present invention can be used as a musical instrument by itself, or when it is attached to a drum.

BRIEF SUMMARY OF THE INVENTION.

It is an object of the present invention to provide a device that will protect a drum rim from damage when struck by a musician playing the drum.

Another object of the present invention is to provide a device that can protect the rims of drums of different sizes from damage when struck by a musician playing the drum.

Still another object of the present invention is to provide a device that is relatively lightweight and is durable.

Another object of the present invention is to provide a device that in readily removable to enable adjustments to be made to the drum skin.

Yet another object of the present invention is to provide a device that is economical to manufacture.

Another object of the present invention is to provide a musical instrument that can be manufactured to provide a variety of different textures and timbres to enhance the performance of a musical arrangement.

Yet another object of the present invention is to provide a musical instrument that can be used by itself.

Another object of the present invention is to provide a musical instrument that can be easily attached to and removed from a drum.

Yet another object of the present invention is to provide a musical instrument that is relatively light-weight.

Still another object of the present invention is to provide a musical instrument that is economical to manufacture.

The present invention is a rim protection device or rim block designed to protect the rim of bass drums from damage when being struck by a musician. The invention comprises of two members having an outer surface, openings on their inner surfaces, one set of holes that receives threaded rods which joins the members, and an arcuate groove sized to receive drum rim therein. The members are joined by a pair of threaded rods which are received in a turnbuckle. The groove in each member deepens from the inner surface towards the outer surface, terminating in a cut surface to which is glued a layer of cushioning material, preferably foam rubber. The device is attached to a drum by separating the two members a distance sufficiently greater than the thickness of the drum, engaging the drum rim within the groove of the first member, engaging a second rim within the groove of the second member, and rotating the turnbuckle so that the members are pulled together and the drum is securely retained there between. The cushioning material prevents the drum rim from being scratched by the device. The members are made from a hard wood such as oak, mahogany, cherry or walnut, or of a plastic, rubber or metal. One or more rim blocks can be mounted on a bass drum. The rim protection device can also be used as a musical instrument, either by itself or when it is attached to a drum. The members of the rim block can be made of different materials for its use as an instrument, such that one device can produce two different tones when struck. These musical tones can be written into a musical score.

BRIEF DESCRIPTION OF THE SEVERAL VIEWS OF THE DRAWING

The invention will be better understood by a Detailed Description of the Invention, with reference to the drawings, of which.

DETAILED DESCRIPTION OF THE INVENTION

Figure 1:
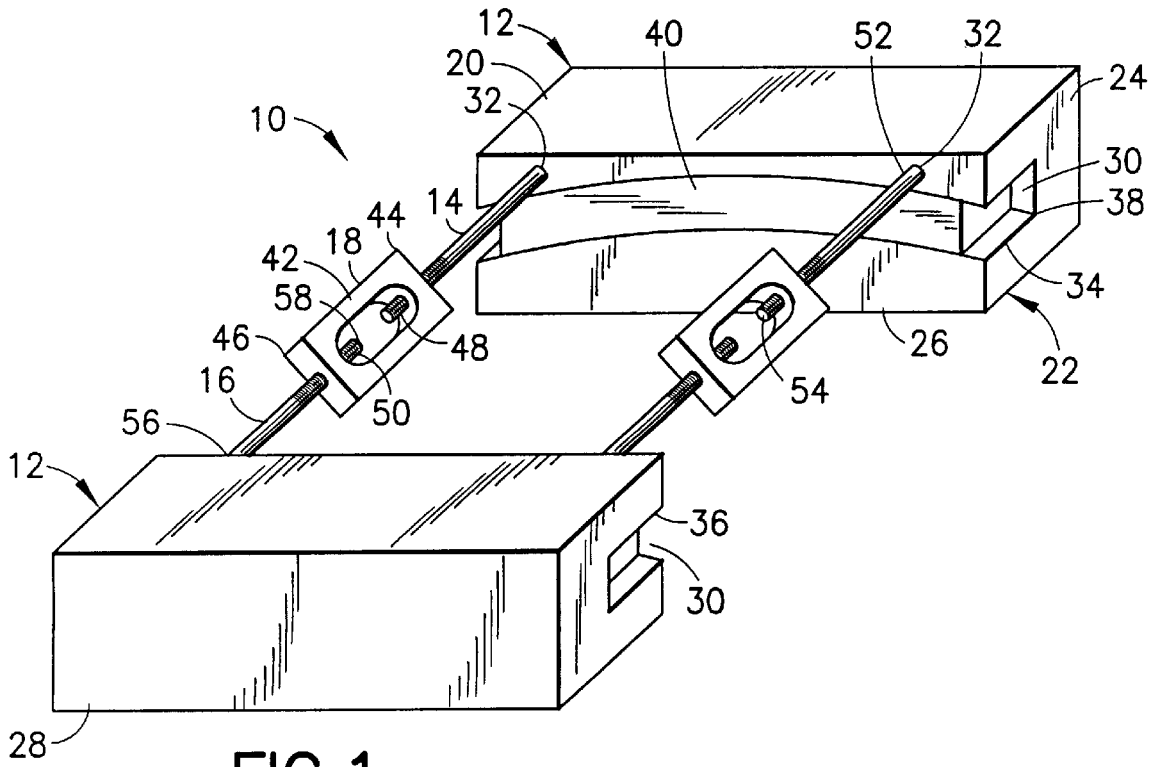
FIG. 1 is a plan view of the present invention.

As shown in FIG. 1, the present invention is a rim protection device or rim block 10 which is designed to fit on a drum. The present invention comprises two members 12 that are connected by threaded rods 14 and 16. The threaded rods 14 and 16 are left and right handed threaded rods, respectively, and as shown in FIG. 1 are connected by a turnbuckle 18. The threaded rods 14 and 16 are constructed with a machine bolt type head 61 so as to prevent the rods 14 and 16 from pulling out when pressure is applied at the turnbuckle 18.

Figure 2:
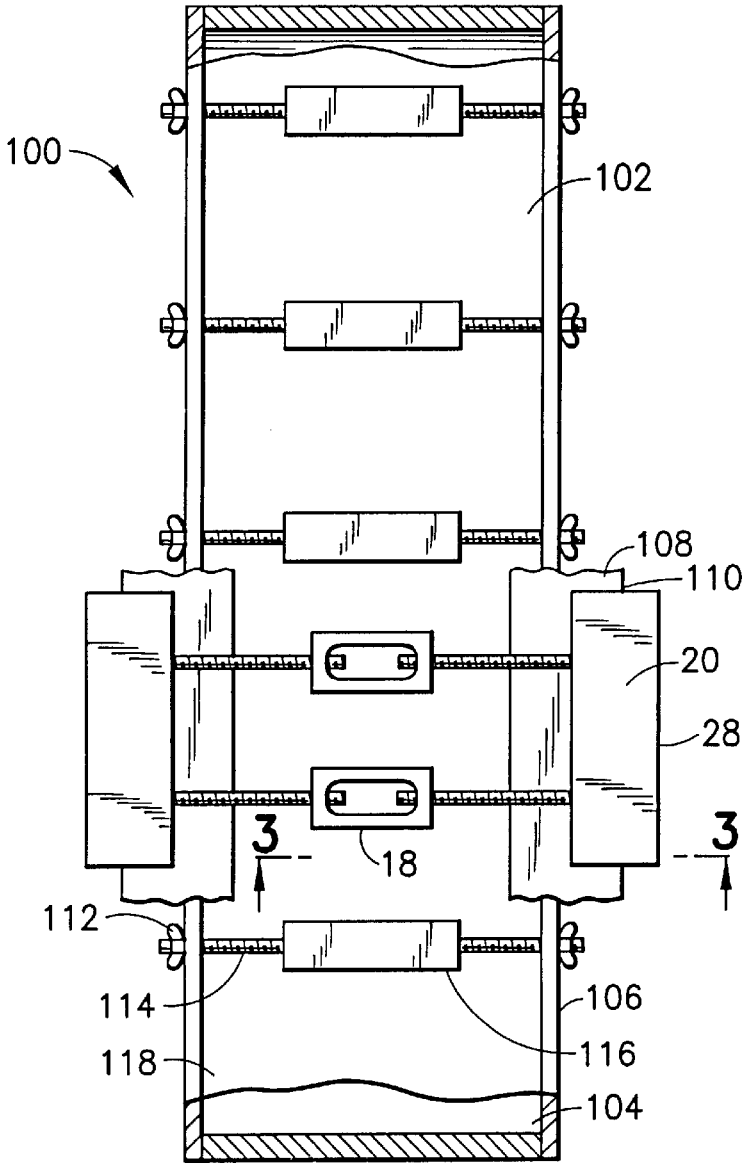
FIG. 2 is a perspective view of the present invention when attached to a bass drum.

Each member 12 has a top surface 20, bottom surface 22, sides 24, an inner surface 26 and outer surface 28. A groove 30 is cut within each member 12, with the groove cut on inner surface 26 and extending towards but not all the way to outer surface 28. The groove 30 is an arcuate groove made by a radius cut and is shaped to follow the curvature of the rim of a bass drum. The preferred embodiment of the present invention is intended for use on bass drums which have a diameter ranging from sixteen to thirty two inches in diameter. FIG. 2 shows how the present invention is mounted on a bass drum, and illustrates the components of a bass drum. In its preferred embodiment, the present invention is intended for use on a bass drum worn by a member of a marching band, wherein the drum is secured to the body of the drummer by means of a harness, as is well known to those skilled in the art. Because the present invention is being attached to a large drum which is worn by an individual for a period of time, it is important that the present invention be lightweight. In an alternate embodiment, the present invention can be attached to a bass drum when the bass drum is used in an upright position when a drummer is performing on a stage and the drummer's drums are set up in the well-known "typical drummer's array of drums.

Two holes 32 are present in the inner surface 26 of each member, and the holes 32 are each threaded and are sized to receive, and receive, one end of each threaded rod 14 and 16. The holes 32 extend through the inner surface 26 and terminates on the extension of the outer surface 28 of each member.

Figure 3:
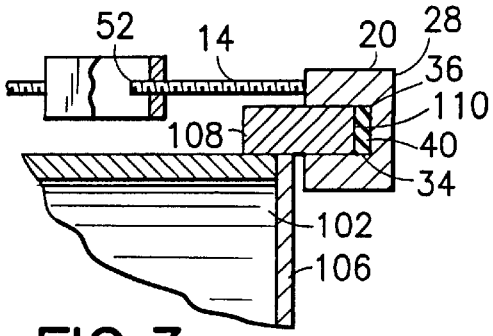
FIG. 3 is a fragmentary view taken along line 3—3 of FIG. 2 showing the engagement of the drum rim edge with the padding inside the groove of one member.

Arcuate groove 30 comprises two walls 34 and 36, each of which deepens from the inner surface 26 towards but not as far as the outer surface 28 and join to form the cut surface 38. A thickness of padding 40 or cushioning material is attached to the cut surface 38 as well as the walls 34 and 36 and serves to prevent cut surface 38 and walls 34 and 36 from scratching the rim 108 of the drum onto which the present invention is attached (FIG. 3). Padding 40 can be selected from a variety of materials that have either a protective or cushioning effect, such as, but not limited to, plastic foam, felt, leather, fabrics, or foam rubber. In the preferred embodiment, padding 40 is a one-eighth inch thickness of foam rubber which is glued to the cut surface 38. Padding 40 can be attached to cut surface 38 by glueing, double sided tape or other means of attachment known to those skilled in the art.

A bass drum 100 is illustrated in FIG. 2. Drum 100 comprises a hollow circular shell 102 or body having two openings 104, a pair of drum skins 106 which are stretched over each opening 104 and are held in place by a circular rim 108 having edge 110. A plurality of fasteners 112, threaded rods 114, and adjusting blocks 116 are spaced around and attached to the outside surface 118 of shell 102 at spaced intervals. These adjusting blocks 116 receive an end of each threaded rod 114, with the other end of threaded rod 114 having a fastener such as a square drive bolt 112 thereon, all of which are used for tightening the drum skin to the shell and for tuning of the drum. As known to those skilled in the art, the drum skin can be an actual skin, or as more commonly used, a thin membrane made from a plastic. The structure of the fasteners and adjusting means are known to those skilled in the art, and will not be further described. The present invention is designed such that when it is attached to a bass drum, the present invention can fit over these clamping and fastening means without interference. Should the drummer need to adjust the tightness of the drum skin or perform other adjustments or tuning, the present invention is readily and easily removable from the drum and these clamping and fastening means can be accessed easily; such an adjustment could also be made while a drummer is marching.

Referring back to FIG. 1, turnbuckle 18 comprises an elongated main body 42 having two ends 44 and 46, with each end containing a threaded opening 48 and 50, respectively, there through. First opening 48 contains right-handed threads, while second opening 50 contains left-handed threads.

Each threaded rod 14 and 16 comprise two ends, 52 and 54, and 56 and 58, respectively, the first end 52 and 56 of each rod being received through the hole 32 of each member, and the second end 54 and 58 being threadably and rotatably received within threaded openings 48 and 50 of turnbuckle 18 as shown in FIG. 1. The threads on threaded rod 14 are right-hand threads while the threads on threaded rod 16 are left-hand threads. Thus, one member receives threaded rods having right handed threads in holes 32, while the other member receives threaded rods having left-handed threads 32.

The preferred embodiment of the present invention is designed to fit bass drums having a diameter between sixteen and thirty-two inches. In the preferred embodiment, the dimensions of members 12 are 6 and one-half inches wide×2 and one half inches high×1 and three-fourths inch deep. The arcuate grooves 30 each have a depth of seven eighths of an inch. Threaded rods 14 and 16 are left and right hand threaded, respectively, and are made from one fourth by 20 threaded rods that are each 8 and three fourths inches long. The turnbuckles 18 each are one quarter by 20 turnbuckles. The dimensions of all these components can be varied to accommodate other sizes of drums. In addition, the present invention could be used as a musical instrument by itself, it can be supported in one hand, or preferably, be mounted on a support stand either by itself or by being attached to a drum.

Each member 12 is manufactured from a durable material. This can be woods such as oak, mahogany, cherry, maple or other hard woods used by those skilled in the art in the manufacture of musical instruments. The members 12 can also be manufactured from plastics such as polyethylene, vinyl plastics, composite plastics or resins, or various types of rubber, knowing that each different material will impart a different tone to the present invention. Two important factors are that the material chosen for the members 12 be durable and able to withstand repeated striking by drum sticks or the mallets used to strike a bass drum, and can be machined to provide smooth surfaces so as not to damage the drums to which they are attached. An additional factor is that the material be capable of being finished to give a pleasing appearance, but this is not critical to the present invention.

To attach the present invention to a drum, the following method is used. First, the members 12 are spread apart by rotating the turnbuckles 18 until the members are spaced apart a distance that is greater than the thickness of the shell 102 of the drum 100 to which the present invention will be attached. The members are spread apart, and the edge 110 of drum rim 108 is engaged within arcuate groove 30 of one member 12, and the turnbuckle 18 is rotated so that the second member is drawn towards the edge 110 of drum rim 108, and the second arcuate groove 30 is guided so as to engage the edge 110 of drum rim 108, and the turnbuckle 18 is turned so that the inside surfaces 26 of each member engage the drum 100 the movement being limited when edge 110 of drum rim 108 engages padding 40. The turnbuckle 18 is then turned so that a snug fit of the present invention 10 is achieved on the drum, with the drum being firmly retained between the two members. The process is repeated as many times as necessary if the drummer is attaching more than one rim protection device to the drum. The drummer can attach the present invention to a drum while the drum is resting on or supported by a solid surface such as a floor.

When the drummer strikes the present invention using a drum stick or mallet, the present invention will absorb the impact and prevent the rim below from being damaged In addition, the sound of the present invention being struck by the drummer can be recognized as a musical note, and that musical note may be included in a musical score so as to enhance the performance of the musical arrangement being performed.

As shown in FIG. 3, the present invention 10 is attached across the outside surface of the shell 102. The present invention is designed so that when it is mounted on a drum, the inner surface 26 of the members 12 does not make contact with the surface of the drum skin.

Variations of the present invention 10 are possible because the present invention can be manufactured from different materials. All such embodiments are capable of protecting the drum rim from damage, but offer the advantage of producing different sounds which can be written into a musical arrangement. In one embodiment, the members 12 of the present invention can be manufactured from two different materials, for example, oak and mahogany, creating a device capable of producing two different sounds. An embodiment in which the members are manufactured from wood and a plastic would have yet a different tone. It is also possible to mount more than one embodiment of the present invention on a bass drum, providing the musician with the ability to produce a variety of different tones.

Therefore, although this invention has been described with a certain degree of particularity, it is to be understood that the present disclosure has been made only by way of illustration and that numerous changes in the details of construction and arrangement of parts may be resorted to without departing from the spirit and scope of the invention.

What is claimed is:

1. A device for protecting a rim of a drum, the device comprising:

a pair of members, each member having a top and bottom surface, an inner surface and an outer surface, and openings in the inner surface, wherein the first opening is a hole, the hole sized to receive a means for joining the members;

a means of joining the members, the means of joining being received in each first opening, the members being joined with the inner surface of a first member facing the inner surface of the second member;

and a groove, the groove being the second opening of each member, the groove being sized to receive a rim of the drum therein; the means of joining being positioned a distance sufficient to separate the members from each other and enable a drum rim to engage the groove of the first member, and for a drum rim to engage the groove of the second member, the means of joining pulling the members towards each other a distance sufficient to retain the drum there between, such that when the device is struck by a drummer, the device is struck rather than the drum rim, thereby protecting the drum rim.

2. The device as described in claim 1, wherein the means of joining the members is a rod.

3. The device as described in claim 2, wherein the rod is threaded.

4. The device as described in claim 3, wherein the means for joining further includes a pair of threaded rods, each threaded rod having a first and second end, the first end of each threaded rod being received in each first opening, and the threaded rods are connected by a turnbuckle means.

5. The device as described in claim 4, wherein the turnbuckle means is a turnbuckle, comprising an elongated main body having two threaded ends, and the second end of each threaded rod is received within the threaded ends of the turnbuckle.

6. The device as described in claim 5, wherein the threaded rods comprises one-fourth by twenty threads.

7. The device as described in claim 6, wherein the groove deepens from the inner surface towards the outer surface, each groove including a pair of inner walls, the inner walls joining at a cut surface.

8. The device as described in claim 7, further comprising a means for cushioning the drum rim attached to the cut surface.

9. The device as described in claim 8, wherein the means for cushioning is manufactured from a material chosen from the group consisting of rubber, felt, plastic, vinyl, leather and fabrics.

10. The device as described in claim 9 , wherein the preferred means for cushioning is foam rubber.

11. The device as described in claim 1, wherein the members are manufactured from a material chosen from the group consisting of woods, plastics and rubbers.

12. The device as described in claim 11, wherein the preferred wood is a hard wood.

13. The device as described in claim 12, wherein the hard wood is selected from the group consisting of oak, mahogany, maple, and cherry.

14. The device as described in claim 1, wherein the members are manufactured from metal.

15. The device as described in claim 1, wherein the drum is a bass drum.

16. A drum comprising:

A. a cylindrical shell having an opening at each end;

B. a drum skin, the drum skin stretched over an opening;

C. a rim at both ends, the rim being sized so as to fit over the shell and retain the drum skin between the shell and the rim, the rim having an edge extending therefrom; and D. a rim device, comprising 1) a pair of members, each member having a top and bottom surface, an inner surface and an outer surface, and openings in the inner surface, wherein the first opening is a hole, the hole sized to receive a means for joining the members;

2) a means of joining the members, the means of joining being received in each first opening, the members being joined with the inner surface of a first member facing the inner surface of the second member; and 3) a groove, the groove being the second opening of each member, the groove being sized to receive and receiving a rim therein; the drum retained between the members by positioning of the means for joining the members, the rim device protecting the drum rim from damage when the drum is struck by a musician using a means for striking.

17. The drum as described in claim 16, wherein the means of joining the members is a rod.

18. The drum as described in claim 17, wherein the rod is threaded.

19. The drum as described in claim 18, wherein the means for joining further includes a pair of threaded rods, each threaded rod having a first and second end, the first end of each threaded rod being received in each first opening, and the threaded rods are connected by a turnbuckle means.

20. The drum as described in claim 19, wherein the turnbuckle means is a turnbuckle, comprising an elongated main body having two threaded ends, and the second end of each threaded rod is received within the threaded ends of the turnbuckle.

21. The drum as described in claim 20, wherein the threaded rods comprises one-fourth by twenty threads.

22. The device as described in claim 21, wherein the groove deepens from the inner surface towards the outer surface, each groove including a pair of inner walls, the inner walls joining at a cut surface.

23. The drum as described in claim 22, further comprising a means for cushioning the drum rim attached to the cut surface.

24. The drum as described in claim 23, wherein the means for cushioning is manufactured from a material chosen from the group consisting of rubber, felt, plastic, vinyl, leather and fabrics.

25. The drum as described in claim 24, wherein the preferred means for cushioning is foam rubber.

26. The drum as described in claim 16, wherein the members are manufactured from a material chosen from the group consisting of woods, plastics and rubbers.

27. The drum as described in claim 26, wherein the preferred wood is a hard wood.

28. The drum as described in claim 27, wherein the hard wood is selected from the group consisting of oak, mahogany, maple, and cherry.

29. The drum as described in claim 16, wherein the members are manufactured from metal.

30. A method for protecting the rim of a drum, the method comprising the steps of:

A. separating the members of a device for protecting the rim of a drum, the drum including:

1) a cylindrical shell having an opening at each end;

2) a drum skin, the drum skin stretched over an opening;

3) a rim at both ends, the rim being sized to fit over the shell and retain the drum skin between the shell and the rim, the rim having an edge extending therefrom;

the rim protection device comprising:

a) a pair of members, each member having a top and bottom surface, an inner surface and an outer surface, and openings in the inner surface, wherein the first openings are holes, which are sized to receive the means for joining the members;

b) a means of joining the members, the means of joining being received in each of the first opening, the members being joined with the inner surface of a first member facing the inner surface of the second member; and c) a groove, the groove being the second opening of each member, the groove being sized to receive a drum rim therein; the means of joining being positioned a distance sufficient to separate the members from each other and enable a drum rim to engage the groove of the first member, and for a drum rim to engage the groove of the second member, the means of joining pulling the members towards each other a distance sufficient to retain the drum there between;

the step of separating the members comprising positioning the means for joining so that the members are spaced apart a distance greater than the thickness of the drum;

B. positioning one member proximate to the edge of a first rim;

C. engaging the edge within the groove of the first member;

D. positioning a second member proximate to the edge of a second rim;

E. engaging the second rim edge within the groove of the second member; and

F. moving the two members towards each other by positioning the means for joining such that the drum rim is retained securely between the members, thereby attaching the device to the drum, such that when the device is struck by a musician, the drum rim is protected from being damaged.

31. The method as described in claim 30, further including the step of attaching a plurality of rim protection devices to the drum.

32. The method as described in claim 30, wherein the drum is a bass drum.

33. A musical instrument comprising:

A. a pair of members, each member having a top and bottom surface, an inner surface and an outer surface, and openings in the inner surface, wherein the first opening is a hole, the hole sized to receive a means for joining the members; and the second opening is a groove; and B. a means of joining the members, the means of joining being received in each first opening, the members being joined with their inner surfaces facing each other, the instrument producing a musical tone when one or more members are struck by a musician using a means for striking an instrument.

34. The instrument as described in claim 33, wherein the means of joining the members is a threaded rod.

35. The instrument as described in claim 34, wherein the means for joining further includes a pair of threaded rods, each threaded rod having a first and second end, and the threaded rods are connected by a turnbuckle means.

36. The instrument as described in claim 35, wherein the turnbuckle means is a turnbuckle, comprising an elongated main body having two threaded ends, and the second end of each threaded rod is received within the threaded ends of the turnbuckle.

37. The instrument as described in claim 33, wherein the members are manufactured from a material chosen from the group consisting of woods, plastics and rubbers.

38. The instrument as described in claim 37, wherein the preferred wood is a hard wood.

39. The instrument as described in claim 38, wherein the hard wood is selected from the group consisting of oak, mahogany, maple, and cherry.

40. The instrument as described in claim 33, wherein the members are manufactured from metal.

* * * * *